US005678804A

United States Patent [19]

Lintelman et al.

[11] Patent Number: 5,678,804

[45] Date of Patent: Oct. 21, 1997

[54] JACKING DEVICE FOR LAWN MOWING EQUIPMENT

[76] Inventors: Timothy Craig Lintelman, 306 Mackie La., Louisville, Ky. 40214; James Thomas Hafendorfer, 12202 Old Shelbyville Rd., Louisville, Ky. 40243

[21] Appl. No.: 599,645

[22] Filed: Feb. 12, 1996

[51] Int. Cl.[6] ..... B66F 3/00

[52] U.S. Cl. ..... 254/131; 254/DIG. 5; 254/133 R

[58] Field of Search ..... 254/124, 131, 254/133 R, DIG. 5, 134; 269/17

[56] References Cited

U.S. PATENT DOCUMENTS

| | | | |
|---|---|---|---|
| 2,521,266 | 9/1950 | Swisher | 254/131 |
| 3,304,060 | 2/1967 | Wanless et al. | 254/131 |
| 3,381,953 | 5/1968 | Miller | 269/17 |
| 4,533,117 | 8/1985 | Schwang | 254/131 |
| 4,838,512 | 6/1989 | Moisan | 254/131 |
| 5,292,107 | 3/1994 | Chick | 254/131 |
| 5,382,131 | 1/1995 | Werthmann | 254/131 |

FOREIGN PATENT DOCUMENTS

| | | | |
|---|---|---|---|
| 1330415 | 5/1963 | France | 254/131 |

*Primary Examiner*—Timothy V. Eley
*Assistant Examiner*—Lee Wilson
*Attorney, Agent, or Firm*—Scott R. Cox

[57] ABSTRACT

A lifting or jacking device for the lifting of lawn mowing equipment comprising an axle with wheels, an extended vertical element secured to the axle, a support element secured to the axle at approximately a 90° angle from the extended vertical element, and a gripping piece, preferably a pair of gripping teeth secured to one end of the support bar. Preferably a foot assist bar is also secured to the extended vertical element to assist the lever element in raising the lawn mowing equipment. In addition, there is preferably secured to the device an extendable safety arm which is extendable from the support element to maintain the lifting device in a fixed position after the lawn mowing equipment has been lifted. Also preferably, the extended lever bar is divided into an upper and lower section, the upper section of which may be rotated to assist in the movement and storage of the lifting or jacking device.

11 Claims, 7 Drawing Sheets

JACKING DEVICE FOR LAWN MOWING EQUIPMENT

BACKGROUND OF INVENTION

1. Field of Invention

This invention relates to lawn mowing equipment. More specifically, this invention discloses a jacking device to assist in the lifting of lawn equipment for servicing, particularly for use with walk-behind mowers.

2. Prior Art

Commercial lawn maintenance companies increasingly use self-propelled, walk-behind lawn mowers. These self-powered lawn mowers are quite heavy and cannot be easily lifted. Often, this equipment needs servicing, such as for the replacement of belts, the repair and/or replacement of blades, fixing flat tires, and for many other maintenance and repair jobs.

Conventional stands affixed to lawn mowers for raising them for servicing these mowers are disclosed, for example, in U.S. Pat. Nos. 2,895,729 and 4,315,395. See also U.S. Pat. Nos. 4,799,656, 3,641,747, 3,665,688, 3,489,428 and 5,324,005. While these devices are useful in limited circumstances, they are not helpful for lifting the lawn mowing equipment by a single individual and retaining that equipment in its raised portion during repair.

Hand carts for carrying large, awkward and sometimes heavy products are also well known. This equipment normally includes a generally flat, horizontal support section for supporting the object to be carried and an upstanding, vertical component secured to the horizontal section and to a pair of wheels, for supporting the back of the object to be lifted and carried. This equipment permits the hauler to lift the object and move it from one location to another location. For example, a specially designed, collapsible handcart of this general construction for carrying a door is disclosed in U.S. Pat. No. 4,746,141. This patent also discloses that the vertical component can be collapsed into a more compact structure permitting easier storage and transportation.

While such carts are helpful, they do not address certain specific problems associated with the lifting and repair of lawn mowing equipment. For example, the surface being lifted in this lawn mowing equipment is several inches off the ground and must be raised a considerable distance above that level for effective servicing. In addition, for repair of the equipment once it is raised, the equipment must be held securely in that raised position. In addition, the cart must be designed so that the lawn equipment can be raised by a single individual. Further, preferably the cart should be designed so that it may be collapsed into a more compact structure for transportation and storage.

Therefore, it is an object of this invention to disclose a jacking device for lifting walk-behind mowers.

It is a still further object of this invention to disclose a jacking device which can be used by a single individual to lift heavy lawn mowing equipment.

It is a still further object of this invention to disclose a jacking device for lifting lawn mowing equipment which utilizes a foot-assist mechanism to assist in raising the lawn mowing equipment.

It is an additional object of this invention to disclose a jacking device for lifting lawn mowing equipment which contains a safety arm for supporting the jacking device after the lawn mowing equipment has been lifted.

It is a still further object of this invention to disclose a jacking device which can be easily collapsed into a more compact structure for storage and transportation.

These and other objects and features of the present invention will become apparent to those skilled in the art from a consideration of the following detailed description, drawings and claims. The description, along with accompanying drawings, provides a selected example of construction of the device to illustrate the invention.

SUMMARY OF THE INVENTION

In accordance with the present invention there is provided a jacking or lifting device for lifting lawn mowing equipment comprising an extended vertical element, an axle and wheels, a horizontal support element, containing a grip jaw and teeth, and a brace running from the horizontal support element to the extended vertical element to hold the device in a fixed position.

Preferably there is secured to the extended vertical element a foot assist device to assist in jacking or lifting the lawn mowing equipment.

Also, preferably there is secured to the device an extendable safety arm device. The extendable safety arm device supports the lifting device while it is in use.

BRIEF DESCRIPTION OF THE DRAWINGS

The invention will be described with reference to the accompanying drawings of which

DETAILED DESCRIPTION

Figure 1:
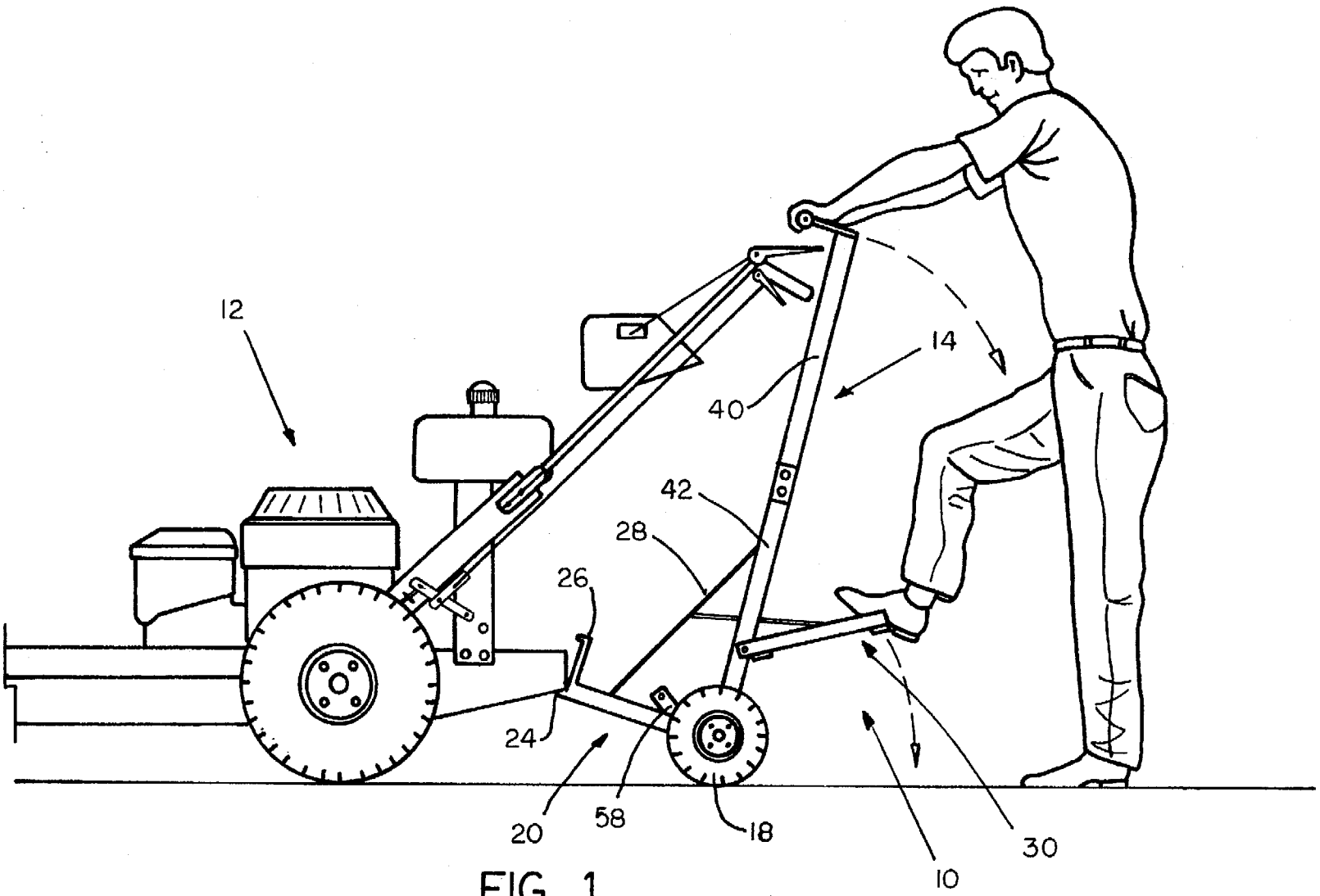
FIG. 1 is a side view of the lifting device beginning to lift the lawn mowing equipment.

Although the invention is adaptable to a wide variety of uses, it is shown in the drawings as embodied in a jacking or lifting device (10) for lifting lawn mowing equipment (12) comprising an extended vertical element (14), an axle (16) and wheels (18), a horizontal support element (20), preferably containing a gripping jaw with teeth (24, 26), and a brace (28) running from the horizontal support element (20) to the extended vertical element (14) to hold the device (10) in a generally L-shaped structure. Preferably, there is also secured to the extended vertical element (14) a foot assist device (30) which is utilized in conjunction with the extended vertical element (14) to assist in jacking or raising the lawn mowing equipment (12). See FIGS. 1 and 2.

Figure 3:
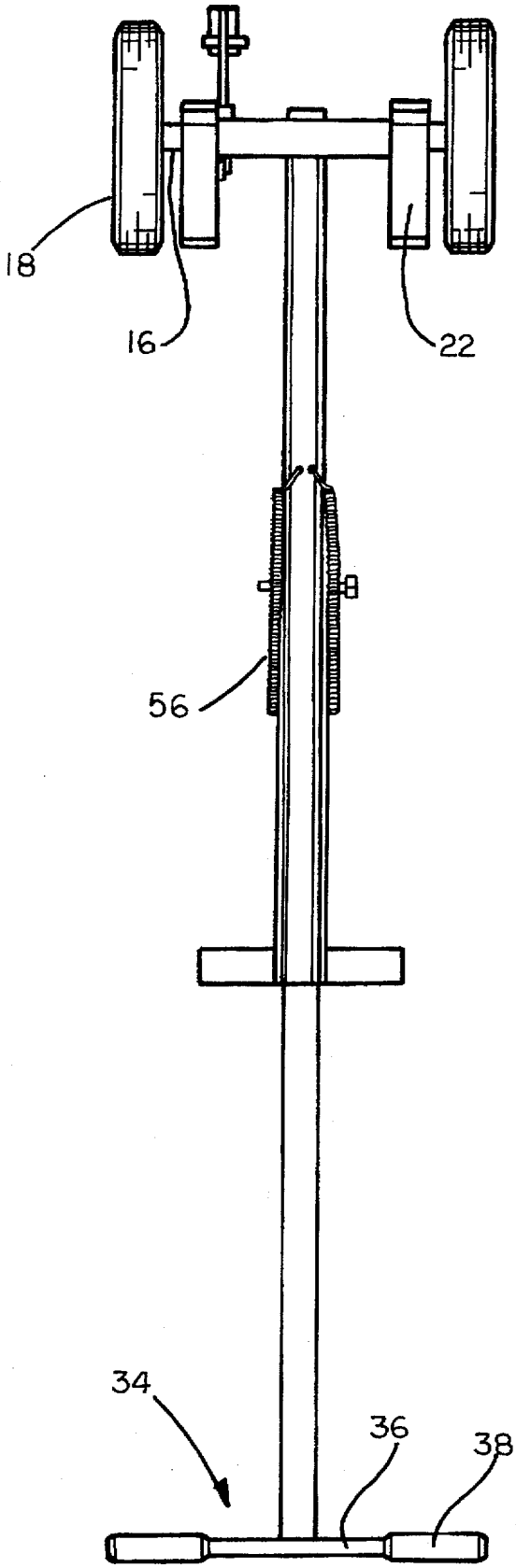
FIG. 3 is a top view of the device.

The lifting device (10) is generally L-shaped, containing a conventional axle (16) and wheels (18). See FIG. 3. The wheels (18) are conventional pneumatic or hard rubber wheels secured to a conventional metal or steel axle. The wheels are generally about 1 to 3 feet apart.

Figure 2:
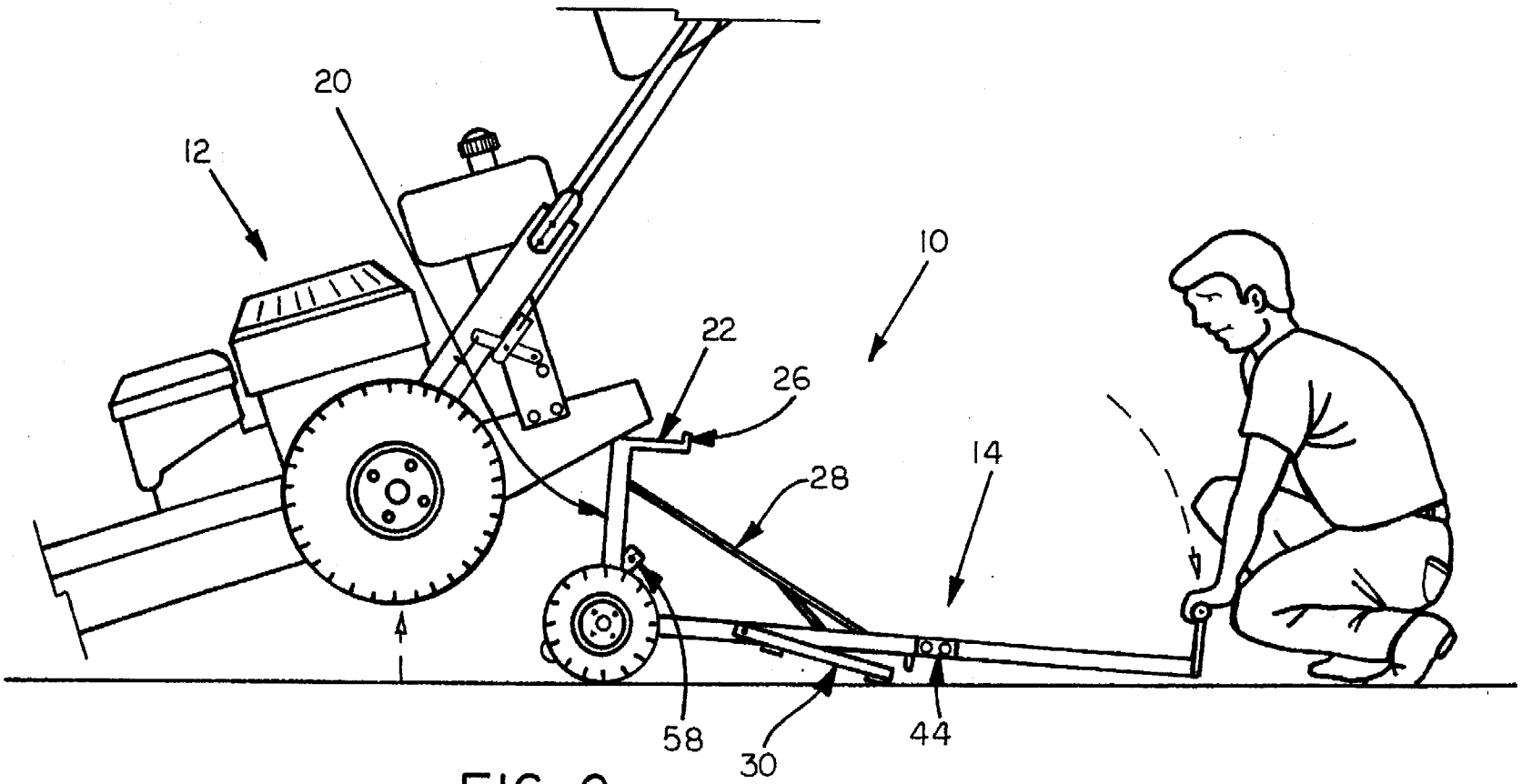
FIG. 2 is a side view of the lifting device after it has lifted the lawn mowing equipment.

Secured to the axle and extending in a generally vertical position when the device is moved to a position to raise the lawn mowing equipment as shown in FIG. 1 is the extended vertical element (14). The vertical element (14) is secured to the axle (6) by conventional securing methods, such as welding. Generally this extended vertical element (14) is from about 3 to about 5 feet in height.

Secured at a top edge (32) of this vertical element is a handle (34). See FIG. 3. Preferably the handle is comprised of a handle bar (36) with grips (38) for gripping the handle when in use. This handle bar (36) extends out at a 90° angle from the extended vertical element (14). Also preferably, the handle bar is extended forward away from the extended vertical element (14) approximately 3 to about 5 inches. This extension is useful preferable so that when the lifting device (10) is in use and the extended vertical element (14) is rotated downward, the hands of the user do not impact with the ground. See FIG. 2.

Figure 4:
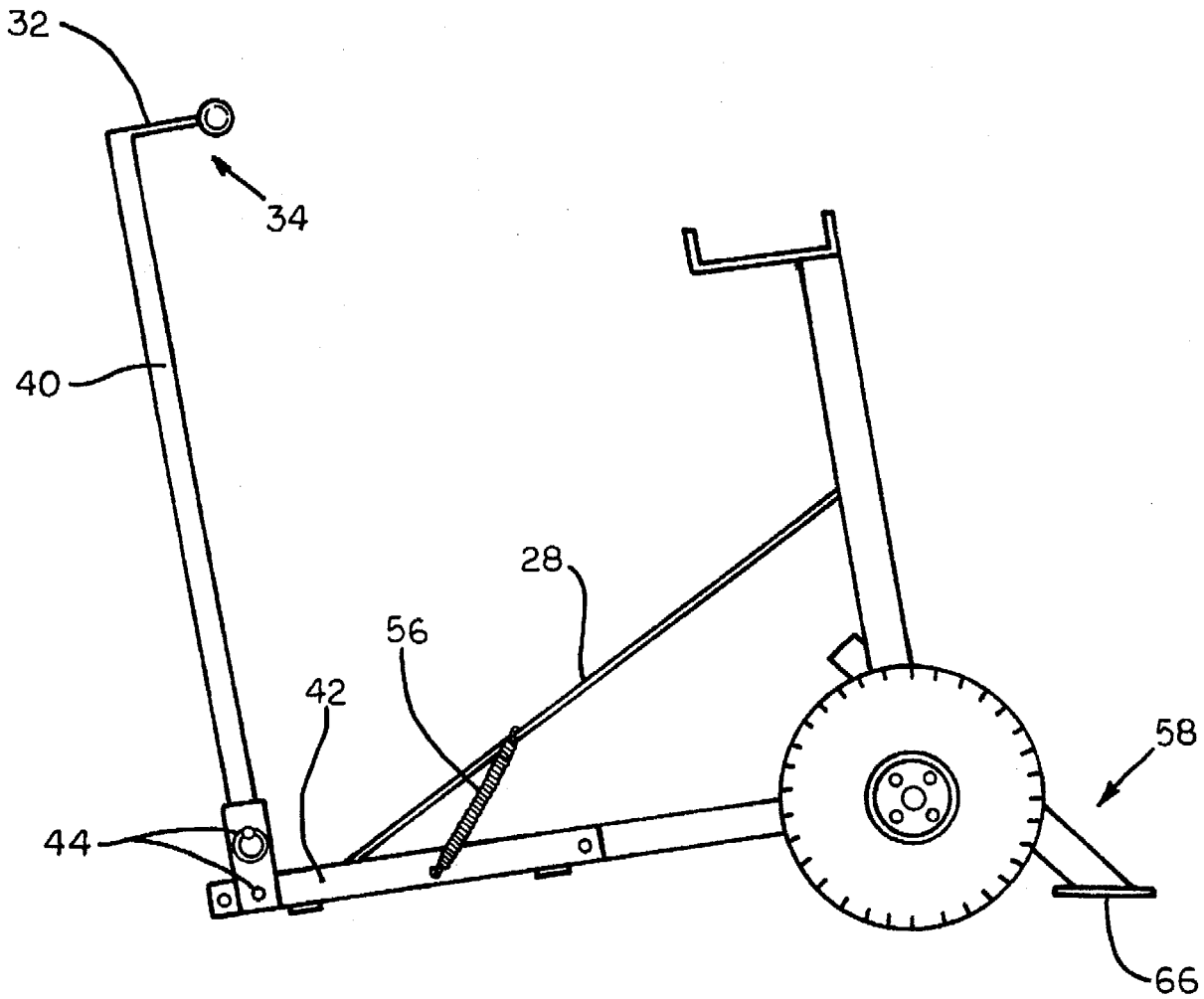
FIG. 4 is a side view of the device with the vertical element partially collapsed into two components with an upper portion rotated 90° in relation to the lower portion.

While the extended vertical element (14) can be a single, unitary piece, preferably it is sectioned into upper (40) and lower (42) sections. See FIG. 4. These two sections are joined together at abutting edges by conventional means such as a hinge. The upper and lower sections (40,42) are maintained in a generally vertical position by use of conventional means such as one or more pins (44) extending through the sections in such a manner as to hold them in place. For storage purposes, the upper section (40) can be rotated to a 90° angle in relation to the lower section (42) by removing one of these pins (44), rotating the upper section upward and pinning it in that position through openings contained in the lower section. See FIG. 4.

The vertical support element and the horizontal support element can be comprised of conventional metal bars or beams such as channel, I-beams, H-beams, box beams, tubular beams and the like. These elements should be quite strong, as they will be utilized to lift heavy lawn mowing equipment.

Figure 7:
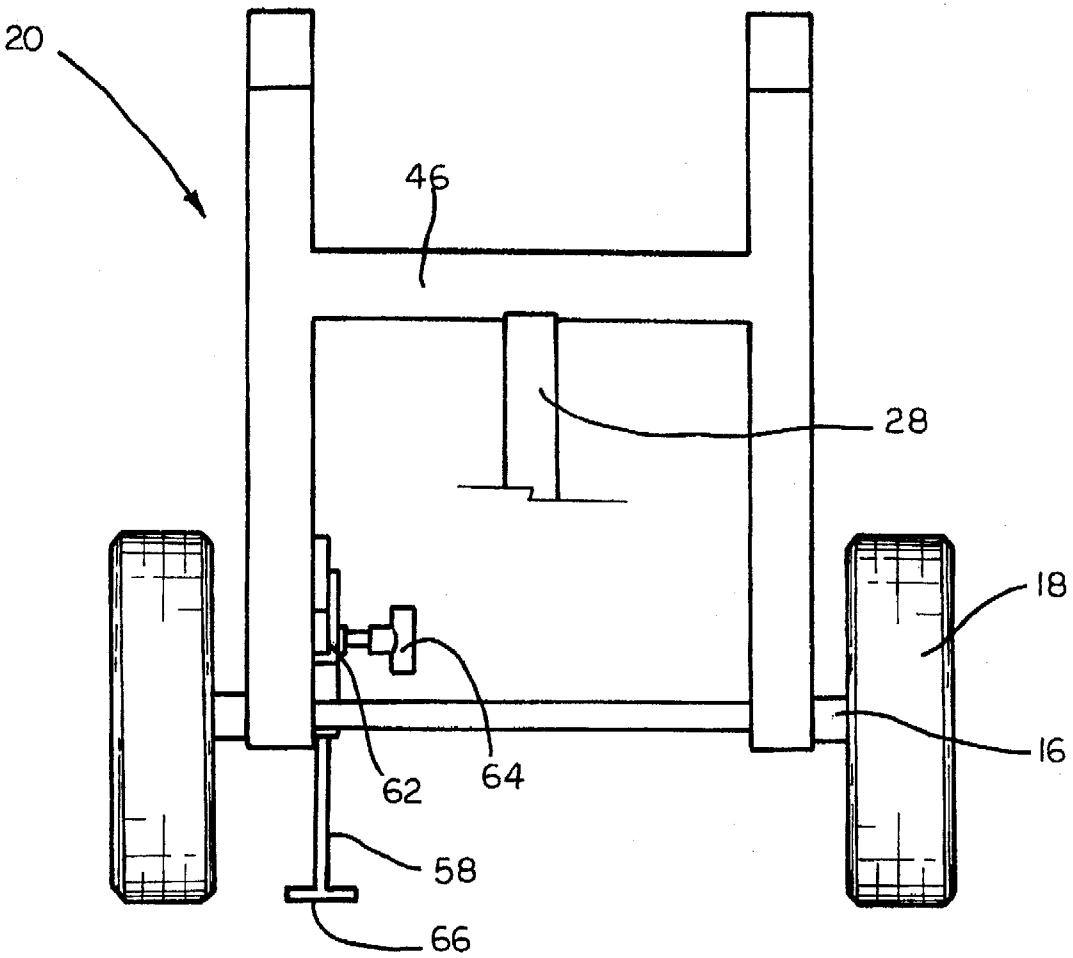
FIG. 7 is a cut-away, end view of the lifting device showing the cross bar and the safety arm device of the horizontal element.

The horizontal support element is generally secured at about a 90° angle to the extended vertical element (14) and is secured to the axle (16) by conventional methods, such as welding. Preferably, a pair of bars form the horizontal support element (20) and extend perpendicular from the extended vertical element (14). See FIGS. 1 and 2. In a preferred embodiment, the support element (20) comprises a group of interconnected bars or beams forming a general H-shape, with a cross bar (46) supporting two extended support bars. See FIG. 7. The length of the support bars is generally from about 6 to about 18 inches, depending upon the height to which the lawn mowing equipment is to be raised for servicing. The support bars and cross bar can be made of the same construction as the vertical element (14).

At the distal end of each of the bars of the horizontal support element (14), are preferably located gripping means for gripping the lawn equipment as it is being lifted. See FIGS. 1 and 7. Preferably the gripping means comprises a gripping jaw (22) with teeth (24, 26). The gripping jaw (22) with teeth is a generally C-shaped piece secured to the end of one of the bars of the horizontal support element (14). The teeth (24, 26) of the C-shaped piece extend upward preferably at least about 2 inches. The purpose of these teeth is to hold the lawn mowing equipment as it is being raised and to continue to hold the lawn equipment in its raised position while the equipment is being serviced. See FIGS. 1 and 2. As with the upper section (40) of the extended vertical element (14), the support element may also be hinged and pivotable to be collapsed until it generally aligns with the vertical bar.

To support the support element (20) and maintain it in its perpendicular position in relation to the extended vertical element (14), there is secured between the vertical element and the support element a brace (28), which is preferably a single bar running from the cross bar (46) of the support element (20) to the lower section (42) of the extended vertical element (14). See FIG. 7. This brace (28) should be of sufficient strength so as to maintain the support element (20) in a generally 90° angle in relation to the extended vertical element (14).

Figure 5:
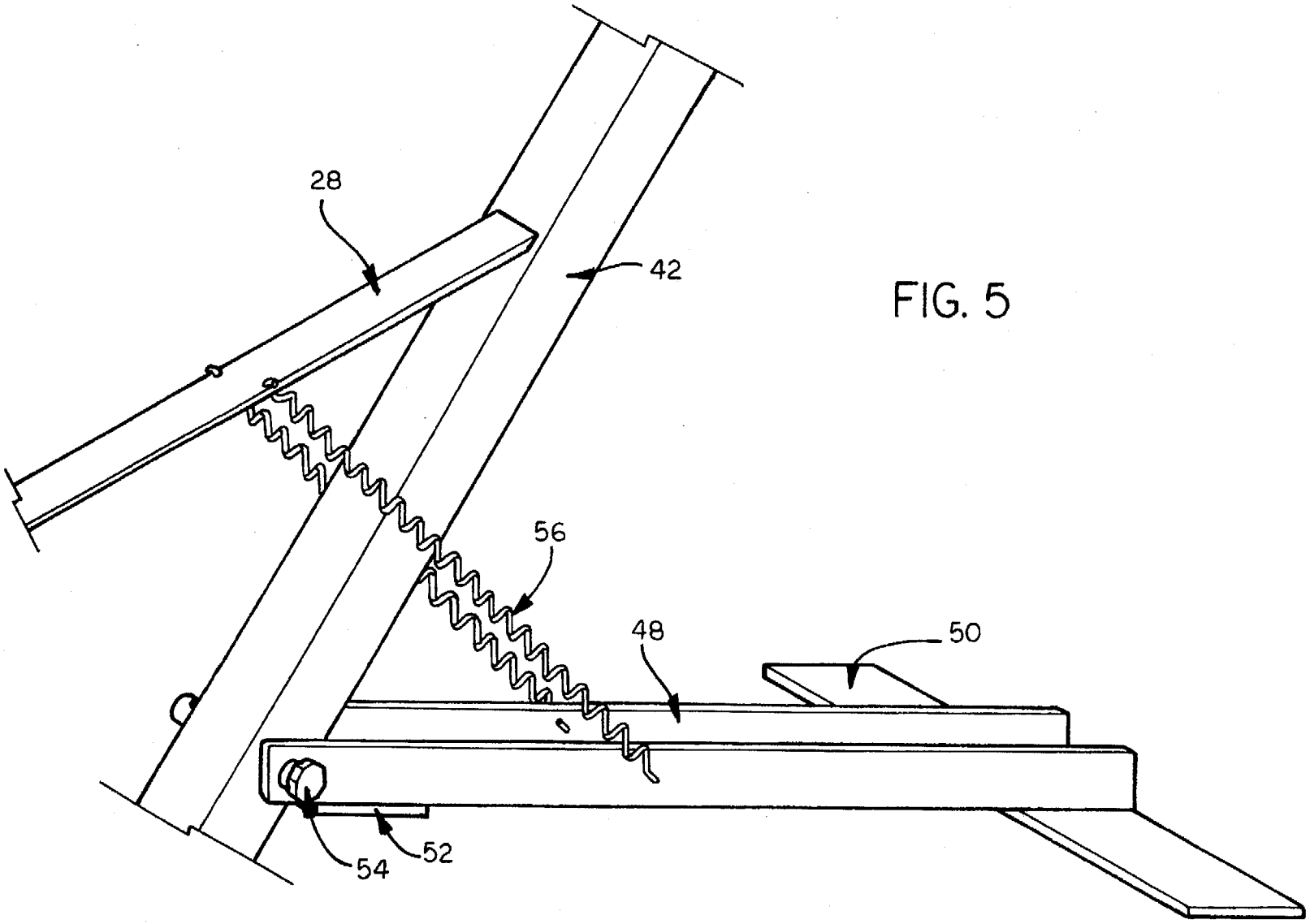
FIG. 5 is a cut-away view of the foot assist device.

In a preferred embodiment, a foot assist bar means, is secured to the extended vertical element (14) to assist in raising the lawn equipment. The foot assist bar means is preferably comprised of a foot assist bar (48), a foot support piece (50), secured to the end of the foot assist bar (48), and a stop means, preferably a stop bar (52), located near the inner end of the foot assist bar. See FIG. 5. The foot assist bar means is preferably secured to the lower section (42) of the extended vertical element (14) by a pin or bolt (54) running through one end of the foot assist bar (48) and through the lower section (42) of the extended vertical element (14). The foot assist bar is generally about 6 to about 18 inches in length. The foot support piece (50) is preferably a flat bar extending perpendicular to the foot assist bar. This foot support bar preferably has pads located on its ends. (Not shown) As the foot assist bar (48) rotates downward away from the lower section (42) of the extended vertical element (14) (see FIG. 1), it is limited in its degree of rotation by the stop bar (52) which is secured to the bottom surface of the foot assist bar (48) near the end of the bar adjacent to the extended vertical element (14). See FIG. 5.

In operation, upon rotation of the foot assist bar (48) downward, the inside edge of the stop bar (52) comes in contact with the lower section (42) of the extended vertical element (14), thus preventing further downward movement of the foot assist bar (48). As additional downward force is placed on the foot support bar (50), the foot assist bar (48) rotates around its pivot point pin (54) where it is secured to the lower section (42) of the extended vertical element (14). Once the foot assist bar (48) reaches the limit of its rotation, where it is stopped by the stop bar (52), the downward force is transferred to the extended vertical element (14), thus providing assistance in the raising of heavy lawn mowing equipment.

Preferably, a spring device (56) is also secured to the foot assist bar (48) to retain it in a position against the extended vertical element (14) when it is not in use. Preferably this spring device (56) runs between the foot assist bar (48) and the brace (28). See FIG. 5. Any such spring-like mechanism which maintains the foot assist bar (48) in a position consistent with that of the extended vertical element (14) is acceptable as a substitution.

Figure 6:
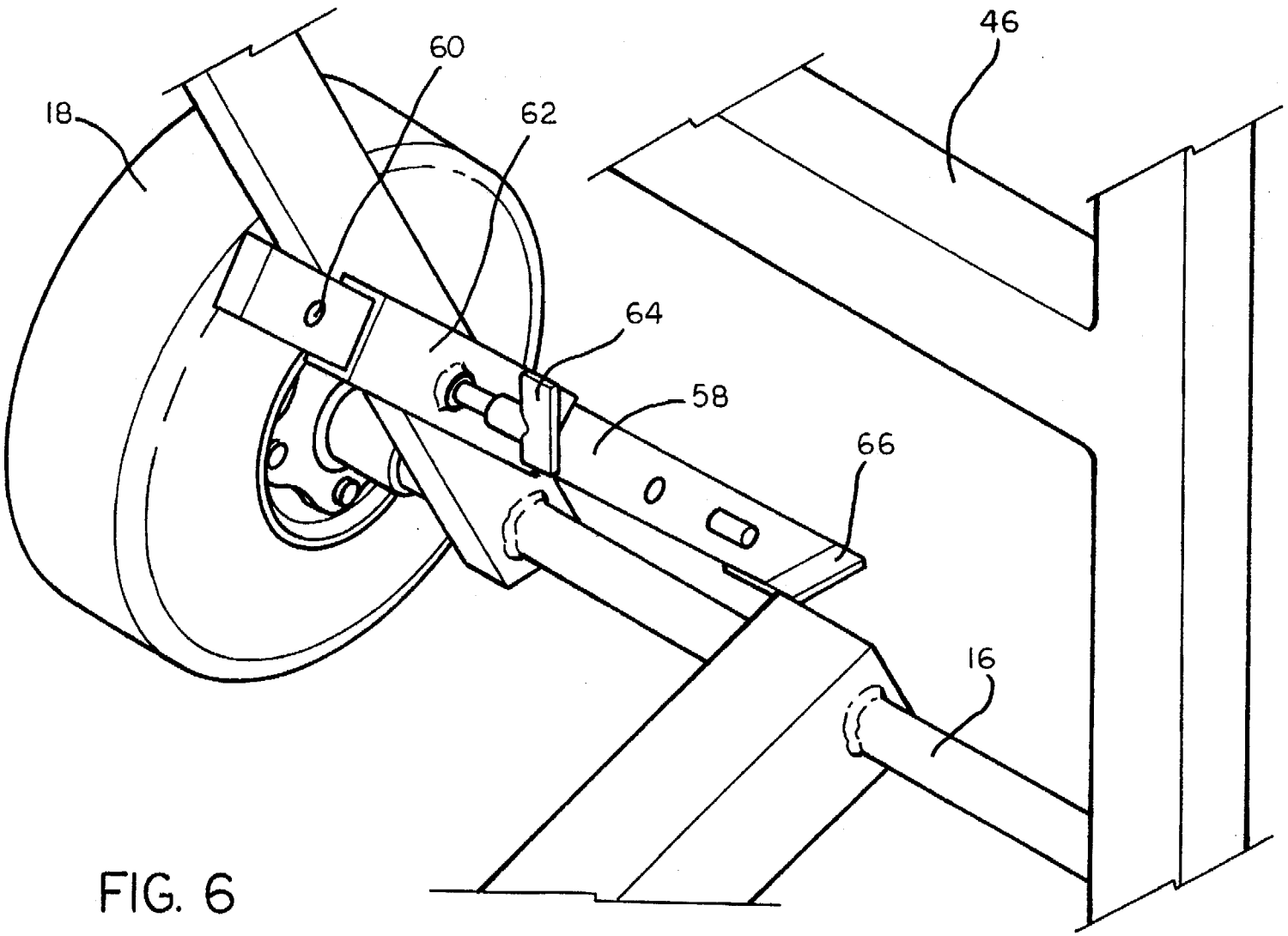
FIG. 6 is a cut-away view of the safety arm device for supporting the lifting device.

In a preferred embodiment, there is also secured to the lifting device (10) an extendable safety arm means, see FIG. 6. Preferably, this extendable safety arm means is secured to the inside surface of one side of the support bar. The extendable safety arm means is comprised of an extendable safety arm bar (58) with openings (60) running therethrough, an external slot (62), or other such mechanism secured to the support element (20) in which the extendable safety arm bar (58) can move, and a securing pin (64) which can extend through both the external slot (62) and the extendable safety arm (58) to secure the extendable safety arm (58) at a particular location. The end of the arm preferably rests against the ground when the extendable vertical element (14) is rotated downward to a generally horizontal position. The angle of the end of the extendable safety arm (58) is also generally horizontal with the ground, thus providing support for the lifting device while in use raising the lawn mowing equipment. In a preferred embodiment, a foot (66) is secured to the end of the extendable safety arm (58) to provide enhanced support for the lifting device (10). The arm, slot, securable pin and foot are also preferably made of a durable steel.

In operation, the lifting device (10) is rolled until it is adjacent to the lawn mowing equipment to be serviced. The teeth (24, 26) on the gripping jaw (22) at the end of the support element (20) are extended until they come in contact with the lower edge of the lawn equipment. See FIG. 1. The lower (24) of the two teeth is placed underneath the lawn mowing equipment (12). The wheels (18) on the axle (16) are then moved forward until there is complete contact between the support element (20) and the lawn mowing equipment with the lower (24) of the two teeth below the level of the lawn equipment. The arm handle bar (36) is then rotated downward, which moves the axle (16) and the wheels (18) forward. See FIG. 1. The lower (24) of the two grip teeth continues to hold onto the lawn equipment as the wheel (18) of the axle (16) move forward. As the vertical element (14) continues rotating to a horizontal position, the lawn mowing equipment (12) continues to be raised. See FIG. 2. To assist in this jacking process, preferably a foot assist bar (48) is rotated away from the extended vertical element (14) by pressure from the foot of the user, providing additional force to raise the lawn mowing equipment (12). Once the extended vertical element (14) is rotated to a generally horizontal position, the extendable safety arm (58) is extended downward until its foot portion (66) is in contact with the ground to support the jacking or lifting device (10) in that position. By this procedure, the lifting device (10) lifts the lawn mowing equipment (12) and holds it safely and securely in position. Once the repair has been completed, the extendable safety arm (58) is retracted, the extended vertical element (14) is rotated upward which slowly lowers the lawn mowing equipment (12). For storage purposes, the upper section (40) of the extended vertical element (14) can be rotated upward by removal of pins (44) which support it in its vertical position. See FIG. 4.

We claim:

1. A lifting device for lifting lawn mowing equipment comprising (a) an axle with wheels, (b) an extended element secured to the axle, (c) a foot assist means secured to the extended element, (d) a safety arm means comprising a beam with openings (e) a support element secured to the axle, and (f) a supporting means secured to an end of the support element for supporting lawn mowing equipment as it is lifted.

2. The lifting device of claim 1 wherein the foot assist means comprises a foot assist bar, a first end of which is secured to the extended element, a foot support bar secured to a second end of the foot assist bar and a stop bar secured to the foot assist bar to limit rotation of the foot assist bar in relation to the extended element.

3. The lifting device of claim 2 wherein a brace is secured between the extended element and the support element.

4. The lifting device of claim 3 wherein a spring is secured between the foot assist means and the brace to limit the rotation of the foot assist bar in relation to the extended element.

5. The lifting device of claim 1 wherein the safety arm means comprises an external slot which is secured to the lifting device.

6. The lifting device of claim 5 wherein the safety arm means is comprised of a retaining means to retain the beam in a fixed position.

7. The lifting device of claim 6 wherein the retaining means to retain the beam is a pin.

8. The lifting device of claim 1 wherein the extended element is sectioned into upper and lower sections.

9. The lifting device of claim 8 wherein the upper section of the extended element is adjustable in relation to the lower section of the extended element.

10. The lifting device of claim 1 wherein an arm handle means is attached to one end of the extended extended element.

11. The lifting device of claim 10 wherein the arm handle means is comprised of a handle bar secured to one end of the extended element, and hand grips secured to the handle bar.

* * * * *